US005400929A

United States Patent [19]

López Gonzalez

[11] Patent Number: 5,400,929

[45] Date of Patent: Mar. 28, 1995

[54] SLIDE-ON CLOSURE FOR CONTAINERS SUCH AS BEVERAGE CARTONS

[76] Inventor: José M. López Gonzalez, C/Bilbao, 3-5 A, Alicante, Spain, E-03001

[21] Appl. No.: 142,363

[22] PCT Filed: Mar. 18, 1993

[86] PCT No.: PCT/ES93/00018

§ 371 Date: Nov. 22, 1993

§ 102(e) Date: Nov. 22, 1993

[87] PCT Pub. No.: WO93/18980

PCT Pub. Date: Sep. 30, 1993

[30] Foreign Application Priority Data

Mar. 20, 1992 [ES] Spain ..... 9200880

[51] Int. Cl.[6] ..... B65D 47/00

[52] U.S. Cl. ..... 222/544; 383/69; 229/125.12

[58] Field of Search ..... 222/153, 544; 383/30, 383/68, 69; 229/125.12, 125.15

[56] References Cited

U.S. PATENT DOCUMENTS

| | | | |
|---|---|---|---|
| 897,594 | 9/1908 | Craw | 383/68 |
| 3,141,221 | 7/1964 | Faulls, Jr. | 383/69 X |
| 5,116,139 | 5/1992 | Young et al. | 383/69 X |

FOREIGN PATENT DOCUMENTS

| | | | |
|---|---|---|---|
| 976221 | 3/1951 | France . | |
| 3801192 | 1/1988 | Germany . | |
| 703569 | 2/1954 | United Kingdom . | |
| 2029203 | 3/1980 | United Kingdom . | |
| 9203994 | 3/1992 | WIPO . | |
| 9318980 | 9/1993 | WIPO | 383/69 |

*Primary Examiner*—Gregory L. Huson

*Attorney, Agent, or Firm*—Jacobson, Price, Holman & Stern

[57] ABSTRACT

A slide-on closure for containers such as beverage cartons is in the form of a tubular body with a longitudinal slit having a divergent section at one end to facilitate sliding of the closure onto the container. The tubular body further includes reinforcements surrounding the body which facilitate gripping the closure and a notch opposite the divergent section which enhances deformation of the closure when sliding same onto the container.

6 Claims, 1 Drawing Sheet

SLIDE-ON CLOSURE FOR CONTAINERS SUCH AS BEVERAGE CARTONS

OBJECT OF THE INVENTION

This invention consists of a slide-on seal or closure which has been specially designed so as to form a sealing device for different types of cardboard or laminated containers such as the cartons used for the marketing of milk, fruit juices, etc.

The slide-on seal described herein enables the container in question, which has been opened and the contents of which have been partially consumed, to be resealed hermetically in a simple, quick, effective way, pending further consumption of the contents.

BACKGROUND OF THE INVENTION

A large variety of liquid products such as those mentioned above and even some solid products are commercialized in plastic bags, hermetically sealed, which keep the contents protected from the surroundings. At other times, plastified cardboard containers are used such as the well-known "tetra-brik". Usually when this type of container is used, in order to consume the product, an oblique cut is made at the corner of the carton thus forming an opening through which the contents may be poured out. This opening usually measures between 1 and 2 cm. although in some cases it may measure more or less.

This type of container poses a two-fold problem. On the one hand, once the carton is opened, the contents run the risk of deteriorating and on the other hand, because of the flexible nature of the carton itself, there exists the likelihood of the contents being spilt while handling the carton.

DESCRIPTION OF THE INVENTION

The slide-on seal described herein has been conceived with a view to eliminating the above problems in an entirely satisfactory way. This sealing device has a simple structure, is easy to use, very effective and assures a water light seal for the carton, once opened, thus protecting the contents both from the deteriorating effect of the surroundings and from being spilt during use through careless handling of the carton.

In order to achieve this, the seal we propose is based on a tubular structure, preferably cylindrical (althugh it may adopt any other form) with a straight, longitudinal slit. The material used for the seal must be sufficiently elastic so as to allow the necessary pressure to be exerted on the sides of the carton which are introduced into the slit, in order to ensure that the opening is sealed all along the line defined by the said slit.

Tom complement this basic struture, the slit has been designed to end in a divergence at one of its extremities. This divergence acts as a guide, enabling the cut sides of the carton to enter the seal easily. Moreover, several reinforcements may be places around the perimeter of the seal in order to make the structure more rigid, thus preventing the appearance of any permanent deformations which would reduce the seal's usefulness and effectiveness.

DESCRIPTION OF THE DRAWINGS

As a complement to the description given and in order to enable a fuller understanding of the invention, we are attaching a set of drawings which form an integral part of this descriptive account. These drawings represent in an illustrative but not restrictive way the following.

RECOMMENDED CONSTRUCTION OF THIS INVENTION

Figure 1:
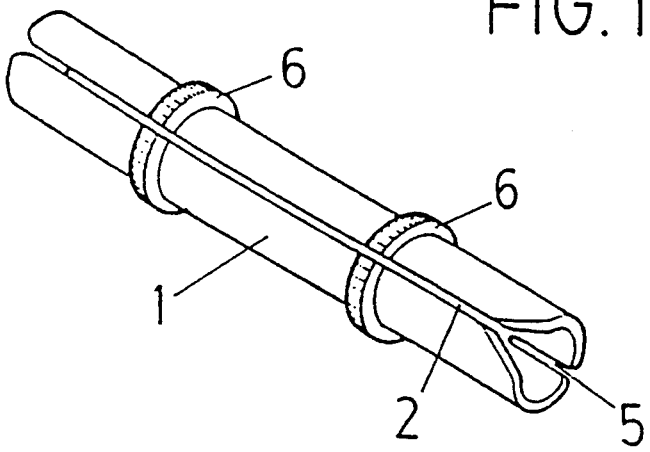
FIG. 1. shows a perspective view of the slide-on seal constructed in accordance with the object of this invention.
Figure 2:
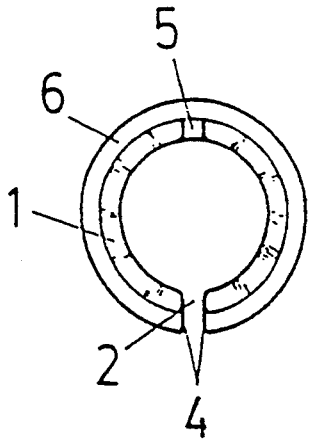
FIG. 2. shows a cross-sectional view of the same device.
Figure 3:
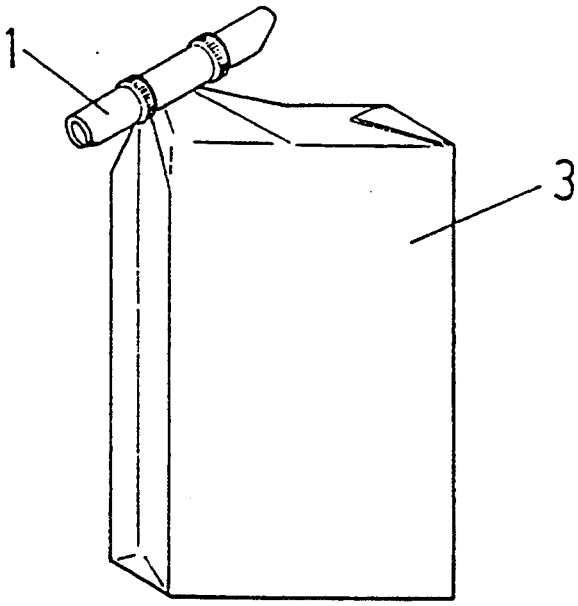
FIG. 3. shows a perspective view of the sealing device used to seal the opening in the corner of the type of carton that is used to commercialize milk, for example.

If we observe the drawings, it can be seen that the slide-on seal or closure is constructed from a tubular body (1) which in the practical example illustrated adopts a cylindrical form. However, it could just as easily adopt any other form such as, for example, a cuadrilateral prism, traingle, pentagon, hexagon, etc. and this would not effect the essence of the invention provided that the basic characteristics, which are essential to its functioning properly, are adhered to. These characteristics are: an appropriate radial elasticity and the existence of a straight longitudinal slit (2) along the entire length of the device, said slit being as narrow as possible (almost of negligible width) so that a radial deformation of the tubular body (1) is necessary in order to fit it on to the cut corner of the carton (3), as shown in FIG. 3, or onto the cut corner of any other type of conventional container having sides of laminated cardboard or plastic, which are brought together to close the container.

In order to facilitate the attaching of the body (1) onto the container in question (3) the longitudinal slit (2) has been designed in such a way that the end that fits on to the carton terminates in a short divergent section (4) which acts as a form of guide to the sides of the carton (3), formed by the cut corner, as they are introduced into the sealing device and slide towards the main operative section of the slit (2).

Moreover, this divergent section (4) is complemented by a small cut or notch (5), preferably opposite it, which facilitates the deformation of the seal at this end where it attaches onto the container.

In accordance with this construction the seal forms a type of elastic peg with a high sealing tension along its operative edges defined by the longitudinal slit (2). This tension may be increased by placing rigidity reinforcements (6) at suitable intervals around the perimeter of the device. In the practical example illustrated there are two such reinforcements but this number may vary without affecting the essence of the invention: Moreover, the reinforcements make the device easier to grip while attaching it to or removing it from the container.

Since the seal has been specially designed for cartons containing food or drink and so as to result in the maximum amount of air being expelled by compressing the carton before it is completely sealed off in order to achieve some degree of vacuum and consequently help keep the contents fresh, the seal should be manufactured in a non-toxic material.

We feel that an expert in the matter will understand the importance of this invention and the benefits that can be derived from it without having to go into any further detail. The materilas used, shape, size and location of its elements may all be varied provided that this does not alter the essence of the invention.

The terms used in this description should always be understood in a broad sense and not a restrictive one.

I claim:

1. A slide-on closure for a container having sides which are brought together to close the container, said closure comprising a tubular body having a longitudinal slit terminating in a divergent section extending to one end of the body to facilitate sliding the closure onto the container over the opening and at least one reinforcement extending peripherally around the body with an opening therein communicating with said slit, said reinforcement facilitating gripping of the closure while attaching same to and removing same from the container.

2. A closure as claimed in claim 1, wherein the body is cylindrical.

3. A closure as claimed in claim 1, including a notch formed in the body from said one end.

4. A closure as claimed in claim 3, wherein the notch is located opposite said divergent section.

5. A slide-on closure for a container having sides which are brought together to close the container, said closure comprising a tubular body having a longitudinal slit terminating in a divergent section extending to one end of the body to facilitate sliding the closure onto the container over the opening and at least one reinforcement extending peripherally around the body with an opening therein communicating with said slit, said reinforcement facilitating gripping of the closure while attaching same to and removing same from the container over the opening, and a notch formed in the body from said one end to facilitate deformation of the closure when sliding same onto the container.

6. A slide-on closure as claimed in claim 5, wherein the notch is located opposite the divergent section.

* * * * *